US007727382B2

(12) United States Patent
Sparks et al.

(10) Patent No.: US 7,727,382 B2
(45) Date of Patent: Jun. 1, 2010

(54) PRODUCTION AND REMOVAL OF FREE-FLOWING COKE FROM DELAYED COKER DRUM

(75) Inventors: Steven W. Sparks, Wenonah, NJ (US); Te-Hung Chen, McLean, VA (US); Christopher P. Eppig, Vienna, VA (US); Michael Siskin, Randolph, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 265 days.

(21) Appl. No.: 11/129,248

(22) Filed: May 13, 2005

(65) Prior Publication Data

US 2005/0269247 A1 Dec. 8, 2005

Related U.S. Application Data

(60) Provisional application No. 60/571,345, filed on May 14, 2004.

(51) Int. Cl.
*C10G 9/14* (2006.01)

(52) U.S. Cl. ..... 208/131

(58) Field of Classification Search ..... 208/131
See application file for complete search history.

(56) References Cited

U.S. PATENT DOCUMENTS

| | | | | | |
|---|---|---|---|---|---|
| 2,626,207 | A | | 1/1953 | Wies et al. | |
| 3,558,474 | A | | 1/1971 | Gleim et al. | 208/108 |
| 3,617,514 | A | | 11/1971 | Marlar | 208/131 |
| 3,684,697 | A | | 8/1972 | Gamson | 208/131 |
| 3,707,459 | A | | 12/1972 | Mason et al. | 208/76 |
| 3,769,200 | A | | 10/1973 | Folkins | 208/53 |
| 3,852,047 | A | * | 12/1974 | Schlinger et al. | 44/530 |
| 4,140,623 | A | | 2/1979 | Sooter et al. | 208/131 |
| 4,226,805 | A | | 10/1980 | Bauer | |
| 4,257,778 | A | * | 3/1981 | Murakami et al. | 208/131 |
| 4,298,455 | A | | 11/1981 | Huang | 208/48 AA |
| 4,399,024 | A | | 8/1983 | Fukui et al. | 208/131 |
| 4,411,770 | A | | 10/1983 | Chen et al. | 208/111 |
| 4,430,197 | A | | 2/1984 | Poynor et al. | 208/56 |
| 4,440,625 | A | | 4/1984 | Go et al. | 208/48 AA |
| 4,455,219 | A | | 6/1984 | Janssen et al. | 208/131 |
| 4,478,729 | A | | 10/1984 | Hunt et al. | |
| 4,518,487 | A | | 5/1985 | Graf et al. | 208/131 |
| 4,529,501 | A | | 7/1985 | George | 208/127 |
| 4,549,934 | A | | 10/1985 | Graf et al. | 196/98 |
| 4,592,830 | A | | 6/1986 | Howell et al. | 208/94 |
| 4,612,109 | A | | 9/1986 | Dillon et al. | 208/131 |
| 4,616,308 | A | | 10/1986 | Morshedi et al. | 364/159 |
| 4,619,756 | A | | 10/1986 | Dickakian | |
| 4,659,453 | A | | 4/1987 | Kukes et al. | |
| 4,659,543 | A | | 4/1987 | Kukes et al. | 208/108 |
| 4,847,018 | A | | 7/1989 | Koepke et al. | |
| 4,927,561 | A | | 5/1990 | Forester | 252/389.22 |
| 4,966,679 | A | | 10/1990 | Kubo et al. | |
| 5,160,602 | A | | 11/1992 | Becraft et al. | 208/131 |
| 5,248,410 | A | | 9/1993 | Clausen et al. | 208/131 |
| 5,251,148 | A | * | 10/1993 | Haines et al. | 700/282 |
| 5,258,115 | A | * | 11/1993 | Heck et al. | 208/131 |
| 5,296,130 | A | | 3/1994 | Kriz et al. | |
| 5,460,714 | A | | 10/1995 | Fixari et al. | 208/112 |
| 5,645,711 | A | | 7/1997 | Hraban et al. | 208/131 |
| 5,650,072 | A | | 7/1997 | McClain et al. | |
| 5,820,750 | A | | 10/1998 | Blum et al. | 208/263 |
| 5,853,565 | A | | 12/1998 | Cayton | 208/48 AA |
| 6,048,904 | A | | 4/2000 | Wiehe et al. | 516/20 |
| 6,168,709 | B1 | | 1/2001 | Etter | 208/131 |
| 6,193,875 | B1 | | 2/2001 | Pereira et al. | 208/130 |
| 6,264,829 | B1 | | 7/2001 | Antalffy et al. | 208/131 |
| 6,387,840 | B1 | | 5/2002 | Salazar et al. | 502/170 |
| 6,611,735 | B1 | | 8/2003 | Henly et al. | 700/266 |
| 6,660,131 | B2 | | 12/2003 | Lah | 202/245 |
| 6,843,889 | B2 | * | 1/2005 | Lah et al. | 202/245 |
| 7,425,259 | B2 | * | 9/2008 | Stark et al. | 208/131 |
| 2002/0033265 | A1 | | 3/2002 | Varadaraj | 166/303 |

(Continued)

FOREIGN PATENT DOCUMENTS

| | | |
|---|---|---|
| EP | 0031697 | 7/1981 |

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Glenn Caldarola
*Assistant Examiner*—Randy Boyer
(74) *Attorney, Agent, or Firm*—Malcolm D. Keen; Glenn T. Barrett

(57) ABSTRACT

A method for producing and removing coke which has bulk morphology such that at least about 30 volume percent is free-flowing under the force of gravity or hydrostatic forces from a delayed coker drum. At the completion of the fill cycle, the coker drum, filled with hot coke, is cooled by steaming and then flooding it with water, thereby producing a coke/water mixture. The coke/water mixture is released from the coke drum through one or more drum closure/discharge throttling systems near the bottom of the coker drum.

22 Claims, 2 Drawing Sheets

U.S. PATENT DOCUMENTS

| | | | | |
|---|---|---|---|---|
| 2002/0125174 | A1 | 9/2002 | Varadaraj | 208/263 |
| 2002/0161059 | A1 | 10/2002 | Varadaraj et al. | 516/113 |
| 2003/0102250 | A1* | 6/2003 | Siskin et al. | 208/131 |
| 2003/0127314 | A1* | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 175511 | 6/1988 |
| EP | 0839782 A1 | 5/1998 |
| GB | 1218117 | 6/1971 |
| WO | 95/14069 | 5/1995 |
| WO | 99/64540 | 12/1999 |
| WO | 03042330 | 5/2003 |
| WO | 03048271 | 12/2003 |
| WO | 2004/104139 | 2/2004 |
| WO | 2004/038316 | 6/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

* cited by examiner

PRODUCTION AND REMOVAL OF FREE-FLOWING COKE FROM DELAYED COKER DRUM

CROSS-REFERENCE TO RELATED APPLICATION

This application claims benefit of U.S. Provisional Patent Application Ser. No. 60/571,345 filed May 14, 2004.

FIELD OF THE INVENTION

The present invention relates to a method for producing and removing coke which has bulk morphology such that at least about 30 volume percent is free-flowing under the force of gravity or hydrostatic forces from a delayed coker drum. At the completion of the fill cycle, the coker drum, filled with hot coke, is cooled by steaming and then flooding it with water, thereby producing a coke/water mixture. The coke/water mixture is released from the coke drum through one or more drum closure/discharge throttling systems near the bottom of the coker drum.

BACKGROUND OF THE INVENTION

Delayed coking involves thermal decomposition of petroleum residua (resids) to produce gas, liquid streams of various boiling ranges, and coke. Delayed coking of resids from heavy and heavy sour (high sulfur) crude oils is carried out primarily as a means of disposing of these low value resids by converting part of the resids to more valuable liquid and gaseous products, and leaving a solid coke product residue. Although the resulting coke product is generally thought of as a low value by-product, it may have some value, depending on its grade, as a fuel (fuel grade coke), electrodes for aluminum manufacture (anode grade coke), etc.

In the delayed coking process, the feedstock is rapidly heated in a fired heater or tubular furnace. The heated feedstock is then passed to a large steel vessel, commonly known as a coking drum that is maintained at conditions under which coking occurs, generally at temperatures above about 400° C. under super-atmospheric pressures. The heated residuum feed in the coker drum generates volatile components that are removed overhead and passed to a fractionator, ultimately leaving coke behind. When the coker drum is full of coke, the heated feed is switched to a "sister" drum and hydrocarbon vapors are purged from the drum with steam. The drum is then quenched by first flowing steam and then by filling it with water to lower the temperature to less than about 100° C. after which the water is drained. The draining is usually done back through the inlet line. When the cooling and draining steps are complete, the drum is opened and the coke is removed after drilling and/or cutting using high velocity water jets.

For example, a hole is typically bored from the top of the drum through the center of the coke bed using water jet nozzles located on a boring tool. Nozzles oriented horizontally on the head of a cutting tool then cut the coke from the drum. The coke removal step adds considerably to the throughput time of the overall process. Thus, it would be desirable to be able to produce a free-flowing coke, in a coker drum, that would not require the expense and time associated with conventional coke removal, particularly the need to drill-out the coke. It would also be desirable to be able to safely remove such substantially free-flowing coke at a controlled flow rate.

One problem associated with removing free-flowing coke from a coke-drum is controlling its removal from the drum.

Coke drums are typically large cylindrical vessels, commonly 19 to 30 feet in diameter and two to three times as tall having a top head and a funnel shaped bottom portion fitted with a bottom head. They are usually used in pairs so that they can be operated alternately. That is, one drum can be on-line while coke is being removed from the other. The heads of a conventional coke drum must be removed to remove the coke. The process of removing and replacing the removable top head and bottom head of the vessel cover is called heading and unheading or deheading. It is dangerous work, with several risks associated with the procedures. There have been fatalities and serious injuries during such procedures. Operators face a significant safety risk from exposure to steam, hot water, fires and repetitive stress associated with the manual unbolting work. Accordingly, the industry has devoted substantial time and investment in developing semi-automatic or fully automatic unheading systems, with attention focused on bottom unheading where the greatest safety hazard is present.

Additionally, if loose coke is let out from the bottom of a coke drum in a rapid and uncontrolled fashion, significant problems can occur. For example, if the flow is too rapid, and the drum top head and/or vent lines are not open, a vacuum can be pulled on the coke drum, imploding the coke drum. Also, rapid dumps of large drums of coke, e.g, dumping 1000 tons (1016.05 Mg) of coke plus its interstitial water in less than about 5 or 10 minutes, can cause significant structural damage to chutes and coke receiving areas.

There are several conventional methods for removing the bottom head of a coker drum out of the way of the falling coke. One method is to completely remove the head from the vessel, perhaps carrying it away from the vessel on a cart. Another method is to swing it out of the way, as on a hinge or pivot, while the head is still coupled to the vessel as in U.S. Pat. No. 6,264,829, which is incorporated herein by reference. Conventional systems all use a manual or semi-automatic bolting system that must be uncoupled with every decoking cycle.

Also, conventional bottom head removal systems require that the heated feed enter the coke vessel from the bottom through the center of the bottom head. Thus, in the typical commercial delayed coker operation, before removing the vessel bottom head for decoking, the feed line must first be disconnected before the bottom head can be removed. Finally, in many coker operations, a coke chute must be manually or hydraulically moved into place and, typically, safety bolts are manually inserted to secure the chute to the drum, allowing the chute to receive the falling coke. The chute directs the coke, as it is drilled out of the vessel, to a receiving area where it is later removed. These methods still require the feed line to be opened up and the head removed before the bottom chute can be brought up and attached to the bottom flange of the vessel.

Considering that there is exposure to personnel and/or equipment when opening the feed line, and considering there is exposure to personnel and/or equipment when opening the bottom head before the chute comes up and is attached, and considering there may still be personnel exposure to steam/hot water between the chute and bottom head after the chute is up, improvements in the coke vessel bottom unheading system to allow safe removal of coke from the vessel is highly desirable, particularly when the coke is a substantially free-flowing coke.

U.S. Patent Application No. 2003/0127314 A1, which is also incorporated herein by reference, teaches a process and apparatus for removing coke from a delayed coker vessel without unheading the vessel bottom. This is accomplished by feeding the resid feedstock into the side of the bottom section of the coker drum and using an aperture closure unit fitted and sealed to the bottom of the coker drum, which aperture closure unit is used to empty the drum of coke. There is no discussion of coke morphology, no suggestion that the coker can contain any quantity of free-flowing coke or that it be in the form of an aqueous slurry, or that the aperture closure member can be throttled to allow the controlled discharge of free-flowing coke in a safe manner.

While there are various teachings in the art for removing coke from coker drums and for various drum hardware solutions, there still remains a need in the art for improved methods of more efficiently emptying free-flowing portions of coke from the coke drum.

SUMMARY OF THE INVENTION

In accordance with the present invention there is provided a process for producing and removing coke which has a bulk morphology such that at least 30 volume percent is substantially free-flowing from a delayed coker vessel, which delayed coker vessel contains: i) a bottom portion defining an aperture through which coke is discharged; ii) at least one inlet feed entry line positioned above said aperture; and iii) a drum closure/discharge throttling system having a closure member and being sealing attached to the bottom of the coker vessel and covering said aperture; comprising:

a) ensuring that the closure member of said drum closure/discharge throttling system is in the closed position;

b) feeding a heated residuum feedstock to a coker vessel through one or more feed lines, which feedstock is one that is capable of producing coke that has a bulk morphology such that at least 30 volume percent is substantially free-flowing under the force of gravity or hydrostatic forces in the coke drum, or one that will form free-flowing coke with use of a suitable additive, under delayed coking conditions;

c) maintaining the coker vessel at delayed coker conditions for an effective amount of time thereby resulting in vapor products and a bed of at least 30 volume percent of substantially free-flowing coke;

d) removing at least a portion of the vapor products overhead;

e) quenching said bed comprised of at least 30 volume percent of substantially free-flowing coke with steam and removing additional vapor products overhead;

f) introducing water into said coker vessel to cool the bed comprised of at least 30 volume percent substantially free-flowing coke;

g) throttling open said closure member in a controlled fashion to allow a controlled discharge of coke from the coker vessel; and h) collecting the coke discharged from the coker vessel.

In a preferred embodiment the enclosure member is a valve selected from the group consisting of a ball valve, a slide valve, a knife valve, and a wedge plug valve.

In another preferred embodiment the delayed coker vessel contains at least about 90 volume percent of substantially free-flowing coke.

In another preferred embodiment, the coker feedstock is blended so that the total dispersed metals of the blend will be greater than about 250 wppm and the API gravity is less than about 5.2

In another preferred embodiment, the fresh coker feed is a vacuum resid which contains less than about 10 wt. % material boiling between 900° and 1040° F. (482.22° C. to 560° C.) as determined by High Temperature Simulated Distillation.

In another preferred embodiment, coker pressure, temperature and steam addition are adjusted to increase the percentage of free-flowing coke in the coker drum.

In still another preferred embodiment an additive is introduced into the feedstock either prior to heating or just prior to it being introduced in the coker vessel, which additive is an organic soluble, organic insoluble, or non-organic miscible metals-containing additive that is effective for the formation of substantially free-flowing coke.

In yet another preferred embodiment of the present invention the metal of the additive is selected from the group consisting, potassium, sodium, iron, nickel, vanadium, tin, molybdenum, manganese, aluminum, cobalt, calcium, magnesium, and mixtures thereof.

In another preferred embodiment there are two feed entry lines positioned opposite of each other.

In yet another preferred embodiment the additive is selected from polymeric additives, low molecular weight aromatic compounds, and overbased surfactants/detergents.

DETAILED DESCRIPTION OF THE PREFERRED EMBODIMENTS

Figure 1:
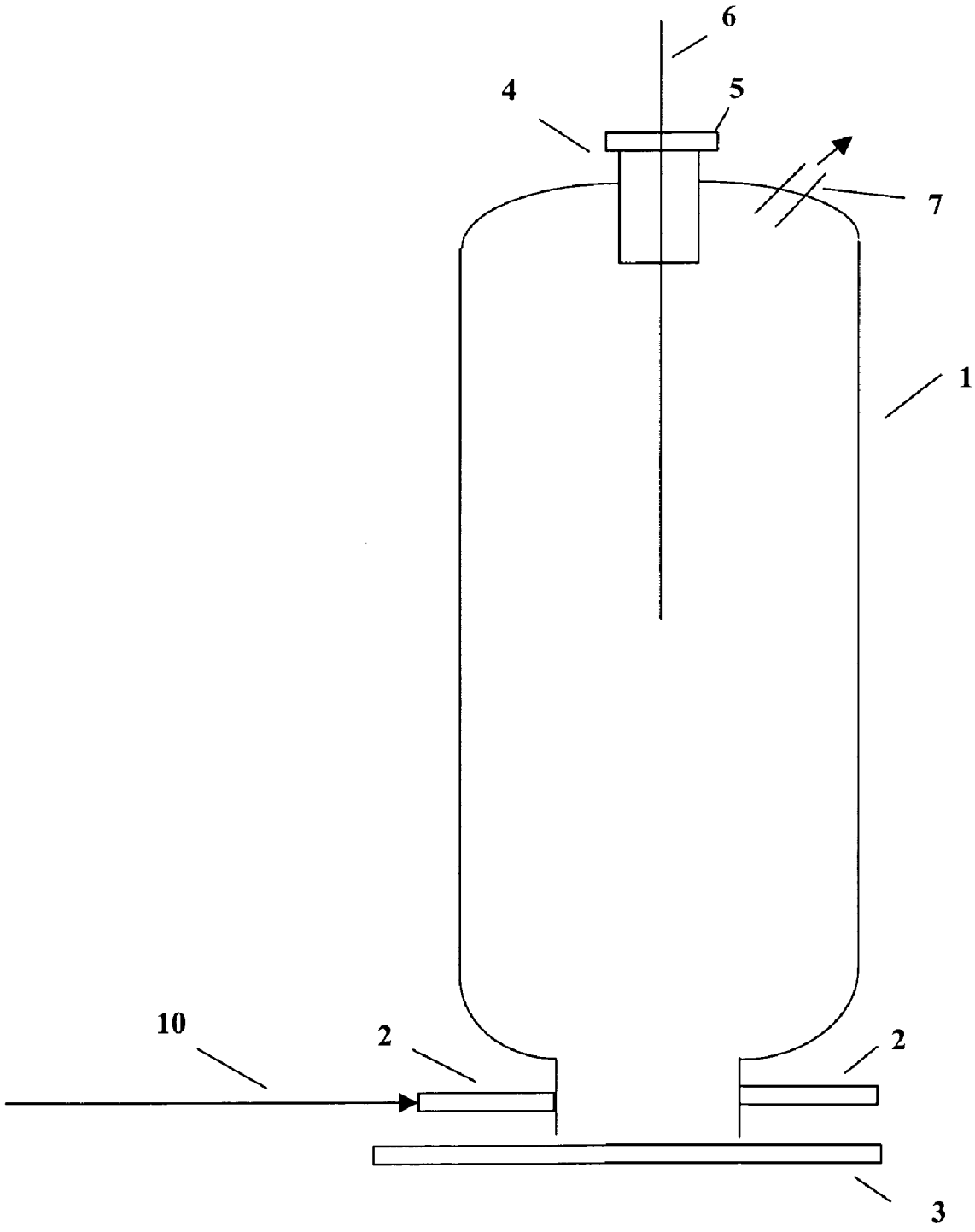
FIG. 1 hereof is a conceptual representation of a coker vessel of the present invention showing the position of the feed injection system and the drum closure/discharge throttling system.

Petroleum residua ("resid") feedstocks are suitable for delayed coking. Such petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking catalysts.

In an embodiment, resid feedstocks include, but are not limited to, residues from the atmospheric and vacuum distillation of petroleum crudes or the atmospheric or vacuum distillation of heavy oils, visbroken resids, tars from deasphalting units or combinations of these materials. Atmospheric and vacuum topped heavy bitumens, coal liquids and shale oils can also be employed. Typically, such feedstocks are high-boiling hydrocarbonaceous materials having a nominal initial boiling point of about 1000° F. (537.78° C.) or higher, an API gravity of about 20° or less, and a Conradson Carbon Residue content of about 0 to 40 weight percent.

The resid feed is subjected to delayed coking. Generally, in delayed coking, a residue fraction, such as a petroleum residuum feedstock is pumped to a heater, or coker furnace, at a pressure of about 50 to 550 psig (344.74 to 3792.12 kPa), where it is heated to a temperature from about 900° F. (482.22° C.) to about 950° F. (510° C.). The heated resid is then discharged into a coking zone, typically a verticallyoriented, insulated coker drum through at least one feed line that is attached to the coker drum near the bottom of the drum. Conventional coker drums require unheading the coke drum. Since the coker drum must contain a severe atmosphere of elevated temperatures, the bottom cover of a conventional coke drum is typically secured to the coke drum by a plurality of bolts, which often must be loosened manually. As a result, unheading is a labor intensive chore. A further drawback of conventional unheading is that it is difficult to use when the coke drum is filled with substantially free-flowing coke, particularly shot coke. Shot coke is unique in that it will not always remain in the drum during and after unheading. This is because the coke is not in the form of a self-supporting coke bed, as is sponge coke, but instead is substantially free-flowing particles. As a result, such coke will have a tendency to uncontrollably pour out of the drum as the bottom cover is being removed, thus creating a safety hazard for operators on the coking unit. In addition, the free-flowing coke may rest on the bottom cover, putting an enormous load on the bottom cover and making its controlled removal difficult.

In one embodiment, represented in FIG. 1 hereof, the coker vessel comprising a vessel 1, also sometimes referred to as a coker drum, that contains a bottom portion defining an aperture (not shown) through which coke is discharged. Feed is passed to vessel 1 via line 10 which enters a feed inlet system 2 which is comprised of one or more feed entry lines into the vessel at a position above the drum closure/discharge throttling system 3. Feed inlet system 2 can merely be a single feed entry line or a manifold with the appropriate pipe entry lines wherein the feed is divided and fed through two or more feed entry lines. It is preferred that there be two feed entry lines, each positioned above the drum closure/discharge throttling system, and each positioned about 180° from each other at the bottom of the vessel. Vessel 1 is also provided with a port 4 at its top, which port contains a removable secured head 5. The port allows for suitable high-pressure water jet equipment 6 to be lowered into the vessel to aid in the removal of the bed of coke that forms during delayed coking. There is also provided a vapor exit line 7 to allow the removal of volatile components that are produced during the delayed coking process.

Drum closure/discharge throttling system 3 can be of any suitable design as along as it contains a closure member for closing off the aperture through which coke is discharged from the bottom of the vessel and as long as it can be throttled at a desired and controlled rate to allow the closure member to be controlled opened at a rate that will allow for the safe discharge of substantially free-flowing coke. It is preferred that the drum closure/discharge throttling system meet one or more of the following criteria:

- It be of a mechanical design such that it can withstand the temperature cycling inherent in delayed coker operations without losing sealing integrity over years of operation
- Its mechanical design is such that it can withstand the static and dynamic pressure loads inherent in delayed coker operations without losing sealing integrity over years of operation
- The design of the closure member (valve) sealing system be such that the coke that is built-up on the process-side of the closure member surface during the coking operation can be cleanly sheared off during the valve opening
- The closure member components that are exposed to the coke plus water mixture be sufficiently robust to resist the erosive nature of the coke water mixture
- The closure member mechanism be capable of controlled opening from the fully closed to fully open position.
- Surfaces of construction materials that are exposed to the feedstock or to the reaction products should be resistant to such species as $H_2S$, $H_2$ and traces of HCl under specified temperature, pressure, and concentration ranges; and to traces of chloride ion in cutting and cooling water under specified conditions.

The drum closure/discharge throttling system can be any suitable valve system for such heavy duty use. Non-limiting examples include single-slide slide valves, a dual-slide slide valves, ball valves, a knife valves, a wedge-within-wedge valves, ram valves, and wedge plug valves.

operated either manually or automatically. If the system is automatically operated then it will be understood that the controller equipment can be located at a location remote from the coke vessel. By remote we mean that it will still be located at the site where the coker vessel is located, but not on the coker process unit itself. The system can be automated by any conventional means. For example, any suitable one or more sensor can be located on the vessel to sense such things as temperature, pressure, coke level in the vessel, and coke discharge rate. It is preferred that at least one of the sensors be an acoustic sensor, especially the sensor that senses the level of coke in the vessel. When a predetermined threshold reading is obtained by the one or more sensors a signal, either wired or wireless, is sent to the controller equipment to open or close the closure member at a predetermined rate. The morphology of the coke within the coke bed can also be a measurement for a sensor since the degree of looseness of a coke can be one of the factors in determining the rate of opening of the closure member. Of course, there will be a manual override of the automated system in case of an emergency. The controller equipment can be any suitable equipment, but will typically include a central processing unit and appropriate software.

One such valve currently available that meets these criteria is a valve manufactured by Zimmermann and Jansen Inc. and is described as a "double disc through conduit gate valve". Such a valve system is disclosed in U.S. Pat. No. 5,116,022. A single slide variant is disclosed U.S. Pat. No. 5,927,684. Also, U.S. Pat. No. 6,843,889 teaches the use of a throttling blind gate valve for discharging coke from a delayed coker. All three of these patents are incorporated herein by reference.

The closure member, which for purposes of this invention will also be called a "valve" actuation and control mechanism must be reliable and have locking and interlocking mechanisms such that the valve cannot be inadvertently opened during the live-drum portion of the coking cycle. This valve is throttle controlled so that one will be able to release the coke from the coke drum at a controlled flow rate. It is preferred that water not be drained from the substantially free-flowing coke, but that it be drained as a slurry. The throttling action is controlled so as not to be so rapid as to pull a vacuum on the drum during the coke water discharge step. The valve is throttled at an effective rate of opening, which effective rate that will allow the discharge of coke at a rate of about 50 tons/hr to 10000 tons/hr (50.8 Mg/hr to 10160.47 Mg/hr), preferred from about 100 tons/hr to 5000 tons/hr (101.6 Mg/hr to 5080.24 Mg/hr), and more preferred from about 200 tons/hr to 2000 tons/hr (203.21 Mg/hr to 2032.09 Mg/hr).

Figure 2:
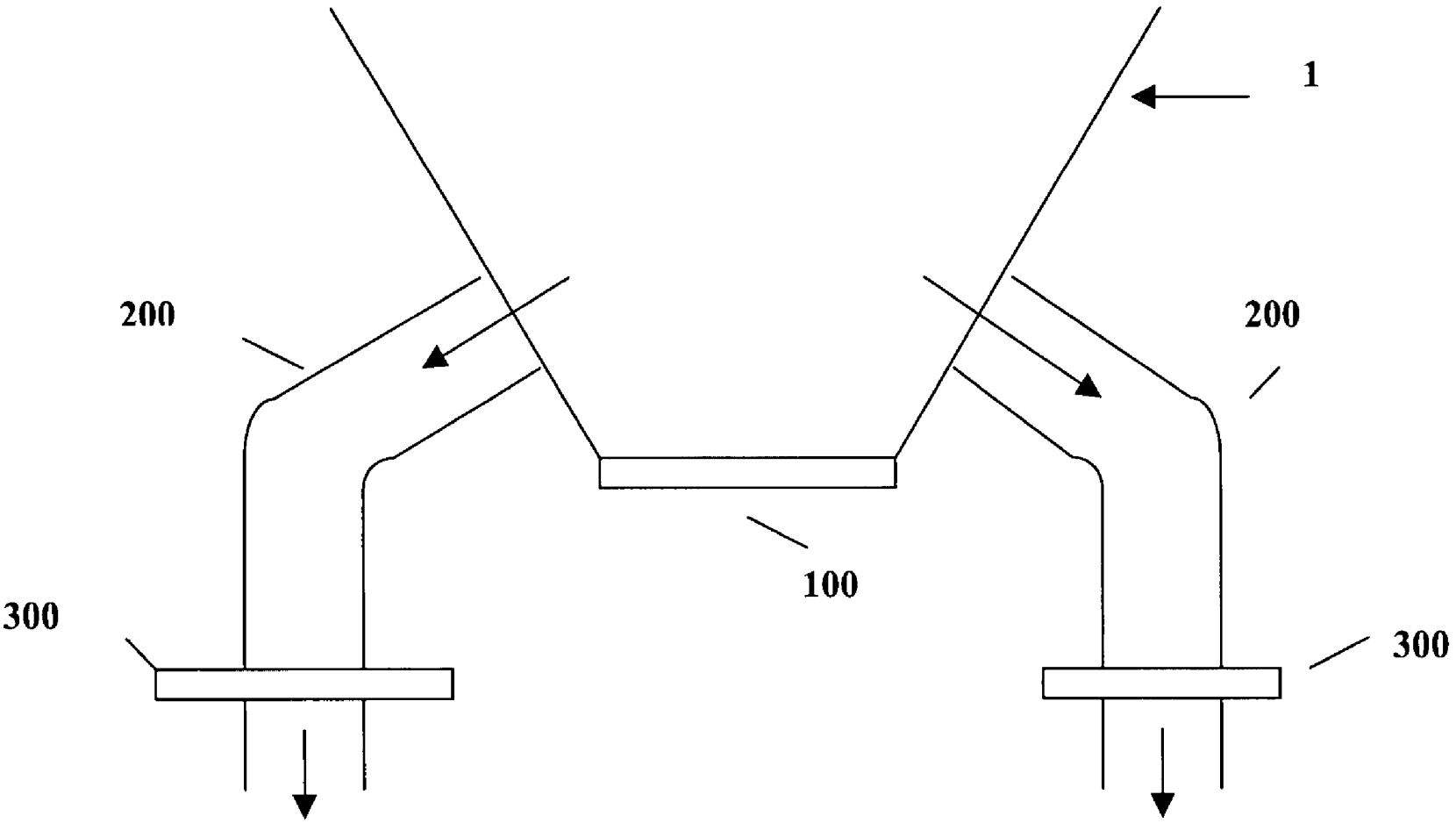
FIG. 2 hereof is another embodiment of the present invention showing a dual coke discharge system.

FIG. 2 hereof is a representation of an alternative discharge throttling system for removing substantially free-flowing coke from a delayed coker vessel. FIG. 2 shows the bottom section of the vessel 1 containing a head 100 closing off the aperture at the bottom of the vessel. Coke is removed via discharge pipes 200 which each contain a discharged throttling system 300 as described for FIG. 1 hereof. It will be understood that more than two such discharge pipes can be used. Feed can be introduced into such an alternative vessel either though head 100 or through feed entry line positioned above head 100 as described for FIG. 1 hereof. Supplemental water jets can be added at strategic locations on lines 200 to help clear out lines 200.

Pressure in the drum during the on-oil portion of the cycle will typically be about 15 to 80 psig (103.42 to 551.58 kPa). This will allow volatiles to be removed overhead. Conventional operating temperatures of the drum overhead will be between about 780° F. to 850° F. (415.56° C. to 454.44° C.), while the drum inlet will be up to about 935° F. (501.67° C.). The hot feedstock thermally cracks over a period of time (the "coking time") in the coker drum, liberating volatiles composed primarily of hydrocarbon products, that continuously rise through the coke mass and are collected overhead. The volatile products are sent to a coker fractionator (not shown) for distillation and recovery of various lighter products, including coker gases, gasoline, light gas oil, and heavy gas oil fractions. In one embodiment, a portion of one or more coker fractionator products, e.g., distillate or heavy gas oil may be captured for recycle and combined with the fresh feed (coker feed component), thereby forming the coker heater or coker furnace charge. In addition to the volatile products, delayed coking of the present invention also forms solid coke which has bulk morphology such that at least about 30 volume percent is free flowing under the force of gravity or hydrostatic forces.

At the completing of the on-oil cycle, steam is typically injected into the coker drum to enhance the stripping of vapor products overhead. During steam stripping, steam is flowed upwardly through the bed of coke in the coker drum and recovered overhead through a vapor exit line 7. After the vapor products are removed, the drum is cooled before the coke can be removed. Cooling is typically accomplished by flowing quench water upwardly through the bed of coke, thus flooding the coke drum. In conventional delayed coking the quench water is then drained through the inlet line, the drum deheaded, and coke removed after drilling with high pressure water jets. In the practice of the present invention water is either drained from the coker vessel prior to the discharge of coke or concurrent with the discharge of the substantially free-flowing coke as a slurry. If water is drained before discharging the coke, the closure member is opened just enough to allow water to drain from the vessel, but not so much that will allow a substantial amount of free-flowing coke to be discharged.

In one embodiment of the invention the bottom portion of the coker vessel is designed and fabricated to be directly sealed to the drum closure/discharge throttling system, whereas in another embodiment, particularly useful for retrofitting existing coker vessels, a bottom transition piece, herein termed a spool, is interposed between the vessel bottom and the drum closure/discharge throttling system and pressure-tightly sealed to both. In either of these two embodiments, a preferred feature is that the drum closure/discharge throttling system is pressure-tightly sealed to either (a) the coker vessel or (b) the spool piece. Preferably the pressure-tight seals will withstand pressures within the range of about 100 psi (689.48 kPa) to 200 psi (1378.95 kPa), preferably within the range of about 125 psi (861.84 kPa) to about 175 psi (1206.58 kPa), and most preferably between about 130 psi (896.32 kPa) to about 160 psi (1103.16 kPa) and thereby preclude substantial leakage of the coker vessel contents including during operation thereof at temperature ranges between about 900° F. and 1000° F. (482.22° C. to 537.78° C.). In embodiment (b) the spool preferably has a side aperture and flanged conduit to which the hydrocarbon feed line, or lines, is attached and sealed.

The present invention substantially reduces or eliminates the dangerous and time consuming procedure of heading and unheading delayed coker vessels, thus rendering the decoking procedure safer for personnel to perform by insulating them from exposure to tons of hot, falling coke, high pressure steam, scalding water, mobile heavy equipment and other extreme hazards. Among other factors, the present invention is based on the conception and finding that substantially free-flowing coke, in a aqueous slurry, is safely and efficiently removed from a delayed coker vessel by the closed system process described herein, which includes side entry for the feed to the vessel and a pressure-tight seal between a closure housing for a vessel bottom aperture. The closure member, which opens and closes at a controlled rate using a throttle mechanism, preferably includes automatic and remote operation of a closure member, such as a valve, located at the bottom of the coker vessel rather than unbolting and removing or swinging away a "head" as in the prior art. One aspect of enabling the process of the present invention is introducing the heated hydrocarbon feed to the coker vessel at a location above and lateral to the coker vessel bottom and the drum closure/discharge throttling system, in combination with the above mentioned pressure-tight seals.

A preferred embodiment of the present invention is additionally based on our finding that coke removal in the present process is advantageously carried out when the coke is a substantially free-flowing coke, preferably a substantially free-flowing shot coke. It is more preferred that the coke be present as an aqueous slurry in the coker vessel prior to its removal from the vessel. As previously mentioned, the slurry is formed when quench water floods the hot coker drum for cooling purposes. The water is drained from the coker drum in conventional delayed coking before coke removal. The present invention is contrary to conventional wisdom in that the quench water is allowed to remain in the coker drum after cooling to temperatures less than about 200° F. (93.33° C.), preferably to less than about 150° F. (65.56° C.), and allowed to form a slurry with the substantially free-flowing coke. By skipping the traditional drain step, and discharging a coke water fluid, significant savings in cycle time may be achieved. This translates to higher potential unit throughput, depending upon other unit bottlenecks.

There are generally three different types of solid delayed coker products that have different values, appearances and properties, i.e., needle coke, sponge coke, and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

There is also another coke, which is referred to as "transition coke" and refers to a coke having a morphology between that of sponge coke and shot coke or composed of mixture of shot coke bonded to sponge coke. For example, coke that has a mostly sponge-like physical appearance, but with evidence of small shot spheres beginning to form as discrete shapes.

Shot coke is considered the lowest quality coke. The term "shot coke" comes from its shape that is similar to that of BB sized [about 1/16 inch to 3/8 inch (0.16 cm to 0.95 cm)] balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and refers to a coke having a morphology between that of sponge coke and shot coke or composed of mixture of shot coke bonded to sponge coke. For example, coke that has a mostly sponge-like physical appearance, but with evidence of small shot spheres beginning to form as discrete shapes.

Any suitable technique can be used to obtain coke that has a bulk morphology such that at least 30 volume percent of substantially free-flowing under gravity of hydrostatic forces. Preferred is at least about 60 volume percent, more preferred is at least about 90 volume percent, most preferred is at least about 95 volume percent, particularly substantially all free-flowing coke. When on 60 volume percent or less of free-flowing coke is present, particularly when only 30 volume percent of free-flowing coke is present, it is preferred that the free-flowing coke be at the lower section of the coker drum so that it can be discharged as a slurry with water before the other coke (sponge) is drilled from the drum. The term "free-flowing" as used herein means that about 500 tons (508.02 Mg) of coke plus its interstitial water in a coker drum can be drained in less than about 30 minutes through a 60-inch (152.4 cm) diameter opening. One technique is to choose a resid that has a propensity for forming shot coke, such feeds include Maya, Cold Lake. Another technique is to take a deeper cut of resid off of the vacuum pipestill. To make a resid that contains less than about 10 wt. % material boiling between about 900° F. (482.22° C.) and 1040° F. (560° C.) as determined by High Temperature Simulated Distillation. Another preferred method for obtaining substantially free-flowing shot coke is the use a suitable additive. In an embodiment, the additive is an organic soluble metal, such as a metal hydroxide, acetate, carbonate, cresylate, naphthenate or acetylacetonate, including mixtures thereof. Preferred metals are potassium, sodium, iron, nickel, vanadium, tin, molybdenum, manganese, aluminum, cobalt, calcium, magnesium and mixtures thereof. Additives in the form of species naturally present in refinery stream can be used. For such additives, the refinery stream may act as a solvent for the additive, which may assist in the dispersing the additive in the resid feed. Additives naturally present in refinery streams include nickel, vanadium, iron, sodium, and mixtures thereof naturally present in certain resid and resid fractions (i.e., certain feed streams). The contacting of the additive and the feed can be accomplished by blending a feed fraction containing additive species (including feed fractions that naturally contain such species) into the feed.

In another embodiment, the metals-containing additive is a finely ground solid with a high surface area, a natural material of high surface area, or a fine particle/seed producing additive. Such high surface area materials include fumed silica and alumina, catalytic cracker fines, FLEXICOKER cyclone fines, magnesium sulfate, calcium sulfate, diatomaceous earth, clays, magnesium silicate, vanadium-containing fly ash and the like. The additives may be used either alone or in combination.

Preferably, a caustic species is added to the resid coker feedstock. When used, the caustic species may be added before, during, or after heating in the coker furnace. Addition of caustic will reduce the Total Acid Number (TAN) of the resid coker feedstock and also convert naphthenic acids to metal naphthanates, e.g., sodium, naphthenate.

Uniform dispersal of the additive into the vacuum resid feed is desirable to avoid heterogeneous areas of shot coke formation. Dispersing of the additive is accomplished by any number of ways, for example, by solubilization of the additive into the vacuum resid, or by reducing the viscosity of the vacuum resid prior to mixing in the additive, e.g., by heating, solvent addition, use of organometallic agents, etc. High energy mixing or use of static mixing devices may be employed to assist in dispersal of the additive agent.

Metals-free additives can also be used in the practice of the present invention to obtain a substantially free-flowing coke during delayed coking. Non-limiting examples of metals-free additives that can be used in the practice of the present invention include elemental sulfur, high surface area substantially metals-free solids, such as rice hulls, sugars, cellulose, ground coals ground auto tires. Additionally, inorganic oxides such as fumed silica and alumina and salts of oxides, such as ammonium silicate may be used as additives.

Overbased alkali and alkaline earth metal-containing detergents are employed as the additive of the present invention. These detergents are exemplified by oil-soluble or oil-dispersible basic salts of alkali and alkaline earth metals with one or more of the following acidic substances (or mixtures thereof): (1) sulfonic acids, (2) carboxylic acids, (3) salicylic acids, (4) alkylphenols, (5) sulfurized alkylphenols, (6) organic phosphorus acids characterized by at least one direct carbon-to-phosphorus linkage. Such organic phosphorus acids include those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of calcium and magnesium. The salts for use in this embodiment are preferably basic salts having a TBN of at least 50, preferably above 100, and most preferably above 200. In this connection, TBN is determined in accordance with ASTM D-2896-88. Overbased alkali and alkaline-earth metal surfactants are disclosed in a co-pending application filed concurrently herewith under Ser. No. 11/127,823, which is also incorporated herein by reference.

Other suitable additives useful for encouraging the formation of substantially free-flowing coke include polymeric additives and low molecular weight aromatic compounds. The polymeric additive is selected from the group consisting of polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyoxypropylene alcohol, ethylene diamine tetra alkoxylated alcohol of polyoxypropylene-polyoxyethylene alcohols and mixtures thereof. The polymeric additive will preferably have a molecular weight range of about 1000 to 30,000, more preferably about 1000 to 10,000. Such additives are disclosed in a co-pending application filed concurrently herewith under Ser. No. 11/127,822, which is incorporated herein by reference.

The low molecular weight additive is selected from one and two ring aromatic systems having from about one to four alkyl substituents, which alkyl substituents contain about one to eight carbon atoms, preferably from about one to four carbon atoms, and more preferably from about one to two carbon atoms. The one or more rings can be homonuclear or heteronuclear. By homonuclear aromatic rings is meant aromatic rings containing only carbon and hydrogen. By heteronuclear aromatic ring is meant aromatic rings that contain nitrogen, oxygen and sulfur in addition to carbon and hydrogen. Such low molecular weight additives are disclosed in a co-pending application filed concurrently herewith under Ser. No. 11/127,821, which is also incorporated herein by reference.

Another preferred embodiment of the present invention is the use of a coke chute bolted and pressure-tightly sealed to the bottom of the closure housing. The chute, which preferably remains attached without removal throughout repetitive coking/decoking cycles, assists in directing coke removed from the coker vessel to a coke receiving area.

In another preferred embodiment, a fluid-flow containing conduit is pressure-tightly sealed to the bottom of the closure housing and flows directly to a coke+water holding tank or bin. Using this system, the coke drum quench cycle time can be reduced to a point where the mixture has cooled to barely below the boiling point of water, and the hot coke plus water mixture is flowed to the holding tank or bin where further cooling water addition can take place. This has the effect of partially decoupling the coke cooling time from the coke drum cycle time, and allows shortening of the coking cycles.

The invention claimed is:

1. A process for producing and removing coke which has a bulk morphology such that at least 60 volume percent is substantially free-flowing from a delayed coker vessel, which delayed coker vessel contains: i) a bottom portion defining an aperture through which coke is discharged; ii) at least one inlet feed entry line positioned above said aperture; and iii) a drum closure/discharge throttling system having a closure member and being sealing attached to the bottom of the coker vessel and covering said aperture; comprising:

a) ensuring that the closure member of said drum closure/discharge throttling system is in the closed position;

b) feeding a heated residuum feedstock to a coker vessel through one or more feed lines, which feedstock is one that is capable of producing coke that has a bulk morphology such that at least 60 volume percent is substantially free-flowing under the force of gravity or hydrostatic forces in the coke drum, or one that will form free-flowing coke with use of a suitable additive, under delayed coking conditions;

c) maintaining the coker vessel at delayed coker conditions for an effective amount of time thereby resulting in vapor products and a bed of at least 60 volume percent of substantially free-flowing shot coke;

d) removing at least a portion of the vapor products overhead;

e) quenching said bed comprised of at least 60 volume percent of substantially free-flowing shot coke with steam injected into the coker drum and removing additional vapor products overhead;

f) introducing water into said coker vessel to cool the bed comprised of at least 60 volume percent substantially free-flowing shot coke and retaining the water in the vessel to form a slurry with the substantially free-flowing shot coke;

g) throttling open said closure member in a controlled fashion to allow a controlled discharge of the substantially free-flowing shot coke and water as a slurry from the coker vessel; and h) collecting the coke discharged from the coker vessel.

2. The process of claim 1 wherein the feedstock is fed into the vessel in at least two locations at the lower section of the coker vessel, but above the aperture where coke is discharged.

3. The process of claim 1 wherein the closure member is a valve selected from the group consisting of a single-slide slide valve, a dual-slide slide valve, ball valve, a knife valve, a wedge-within-wedge valve, a ram valve, and a wedge plug valve.

4. The process of claim 1 wherein the drum closure/discharge throttling system is a double block and purge valve assembly.

5. The process of claim 3 wherein the valve has at least one steam purge means.

6. The process of claim 1 wherein the drum closure/discharge throttling system is actuated by a hydraulically-powered system.

7. The process of claim 1 wherein the drum closure/discharge throttling system is actuated by an electrically-powered system.

8. The process of claim 1 wherein the drum closure/discharge throttling system is actuated by a manually powered system.

9. The process of claim 1 wherein the control of the drum closure/discharge throttling system is automated.

10. The process of claim 9 wherein the drum closure/discharge throttling valve is controlled by one or more input signals from the coker drum that activate a signal in response to predetermined set points for one or more of process temperature, pressure, level of coke in the drum, and coke discharge rate.

11. The process of claim 1 wherein the opening and closing forces of the drum closure/discharge throttling system are measured in relation to the percent closure of closure member.

12. The process of claim 1 wherein the coker feedstock is blended so that the total dispersed metals content of the blend will be greater than about 250 wppm and the API gravity will be less than about 5.24.

13. The process of claim 1 wherein the coker feed is a vacuum resid that contains less than about 10 wt. % material boiling between 900° F. (482.22° C.) and 1040° F. (560° C.) as determined by HTSD (High-temperature Simulated Distillation).

14. The process of claim 1 wherein an additive is used to aid in the formation of coke comprised of at least 60 volume percent of substantially free-flowing coke.

15. The process of claim 14 wherein the additive is selected from the group consisting of metals-containing additives, non-metals containing additives, overbased alkali and alkaline-earth surfactant additives, polymeric additives and low molecular weight aromatic additives.

16. The process of claim 14 wherein the additives is an organic soluble, organic insoluble, or non-organic miscible metals-containing additive that is effective for the formation of substantially free-flowing coke.

17. The process of claim 16 wherein the metal of the additive is selected from the group consisting of sodium, potassium, iron, nickel, vanadium, tin, molybdenum, manganese, aluminum, cobalt, calcium, magnesium, and mixtures thereof.

18. The process of claim 14 wherein the additive is an overbased alkali or alkaline-earth surfactant selected from the group consisting of: (i) sulfonic acids, (ii) carboxylic acids, (iii) salicylic acids, (iv) alkylphenols, (v) sulfurized alkylphenols, and (vi) organic phosphorus acids characterized by at least one direct carbon-to-phosphorus linkage.

19. The process of claim 1 in which the coke is a solid in the form of substantially free-flowing particles.

20. The process of claim 1 in which the coke is a solid in the form of substantially free-flowing particles and which is free-flowing under the force of gravity or hydrostatic forces.

21. The process of claim 1 in which the coker vessel is maintained at delayed coker conditions including a temperature of 900 to 1000° F. for an effective amount of time to result in vapor products and a bed of at least 60 volume percent of substantially free-flowing coke.

22. The process of claim 1 in which the bed of coke in the coker vessel comprises at least 90 volume percent of substantially free-flowing coke.

* * * * *